United States Patent [19]

Jahnke et al.

[11] Patent Number: 4,944,235

[45] Date of Patent: Jul. 31, 1990

[54] ATTACHMENT MECHANISM FOR ATTACHING A DESK TOP TO A SUPPORT STRUCTURE

[75] Inventors: Eitelfriedrich Jahnke, Korbach; Detlef Hänsel, Lippstadt-Dedinghausen, both of Fed. Rep. of Germany

[73] Assignee: Gesika Buromobelwerk GmbH & Co. KG, Geseke, Fed. Rep. of Germany

[21] Appl. No.: 420,066

[22] Filed: Oct. 11, 1989

[30] Foreign Application Priority Data

Oct. 18, 1988 [DE] Fed. Rep. of Germany ..... 3835365

[51] Int. Cl.[5] ..... A47B 3/06

[52] U.S. Cl. ..... 108/157; 108/154

[58] Field of Search ..... 108/157, 159, 154, 155; 248/188, 188.1; 292/40

[56] References Cited

U.S. PATENT DOCUMENTS

| | | | |
|---|---|---|---|
| 900,247 | 10/1908 | Williams | 108/157 X |
| 950,739 | 3/1910 | Baum | 108/159 |
| 1,142,463 | 6/1915 | Shepherd | 292/40 |
| 2,644,733 | 7/1953 | Castle | 108/157 |
| 2,729,279 | 1/1956 | Axtell et al. | 108/157 X |
| 4,317,416 | 3/1982 | Baum et al. | 108/157 |
| 4,387,917 | 6/1983 | Cocker | 292/40 |

FOREIGN PATENT DOCUMENTS

| | | | |
|---|---|---|---|
| 665701 | 6/1963 | Canada | 108/154 |

*Primary Examiner*—José V. Chen

*Attorney, Agent, or Firm*—Pollock, VandeSande and Priddy

[57] ABSTRACT

A desk/table top is attached to a support structure without the need of separate tools by use of a manually operable attachment mechanism that is mounted on the underside of the top. The attachment mechanism includes a latching lever mounted for pivotal movement and a pair of clamp levers mounted for horizontal linear motion toward and away from one another in response to pivotal motion of the latching lever. The clamp levers include portions which are adapted to extend into openings in hollow tubes that comprise cross beams in the support structure when the top is fixedly attached to the support structure.

10 Claims, 2 Drawing Sheets

ATTACHMENT MECHANISM FOR ATTACHING A DESK TOP TO A SUPPORT STRUCTURE

BACKGROUND OF THE INVENTION

The present invention relates to a mechanism for attaching a desk or table top (hereinafter generically referred to as a "desk" top) to a support structure without the use of separate tools.

The most widely used method of attaching a desk top to a support structure is based on the use of screws or bolts which are manipulated by a screw driver or wrench. The result of employing this kind of attachment is that a desk cannot be assembled or disassembled without employing separate tools. Moreover the assembly or disassembly of the desk is comparatively difficult, and time consuming.

The object of the present invention is to provide a desk construction which is characterized by the provision of a manually operable attaching mechanism which makes it possible to effect fast and easy assembly and disassembly of a desk top to an underlying support structure without the need of separate tools. The attachment mechanism can be operated quickly and easily by unskilled persons, achieves a secure and strong attachment between the desk top and its associated support structure, and assures that the weight of the top is evenly distributed on the underlying support structure.

SUMMARY OF THE INVENTION

The foregoing objects of the invention are achieved by use of an attachment mechanism which is mounted on the underside of a desk top, and which can be manually operated without the need of separate tools to assemble or disassemble a desk top and an associated support structure.

The support structure comprises a pair of vertical pedestals disposed in spaced relation to one another, and a pair of elongated horizontally extending parallel cross beams that are disposed between the pedestals adjacent the tops of the pedestals at a location below the desk top when the desk top is mounted on the support structure. Each cross beam includes abutments thereon, e.g., the cross beams may take the form of hollow tubes of square or rectangular cross section having openings in at least one side thereof that can be engaged by hooks at the ends of a pair of elongated clamp levers that form a portion of the attachment mechanism. The attachment mechanism further includes a manually operable latching lever that is mounted for pivotal motion in a plane parallel to the underside of the desk top, and motion changing means responsive to pivotal motion of the latching lever in one direction for effecting linear motion of the clamp levers into engagement with the cross-beam openings, and responsive to pivotal motion of the latching lever in a direction opposite to said one direction for disengaging the clamp levers from said openings.

The latching lever is mounted for pivotal motion on a pivot structure that is disposed between inner end portions of the clamp levers, the pivot structure defining an axis of rotation of the latching lever that can be linearly displaced in the direction of elongation of the clamp levers. The motion changing means includes a pair of spaced pins disposed between the latching lever and clamp levers in a pair of elongated slots that are transverse to the directions of elongation of the clamp levers. By pivoting the latching lever in one direction, the clamp levers, or clamp hooks attached to the clamp levers, are moved in translation into openings in the cross beams of the support structure to fixedly assemble the desk top on the support structure. When the latching lever is pivoted in the opposite direction, the clamp levers or clamp hooks are retracted from the cross-beam openings to permit the desk top to be disassembled from the underlying support structure.

BRIEF DESCRIPTION OF THE DRAWINGS

The foregoing objects, advantages, construction and operation of the present invention will become more readily apparent from the following description and accompanying drawings wherein.

DESCRIPTION OF THE PREFERRED EMBODIMENTS

Figure 1:
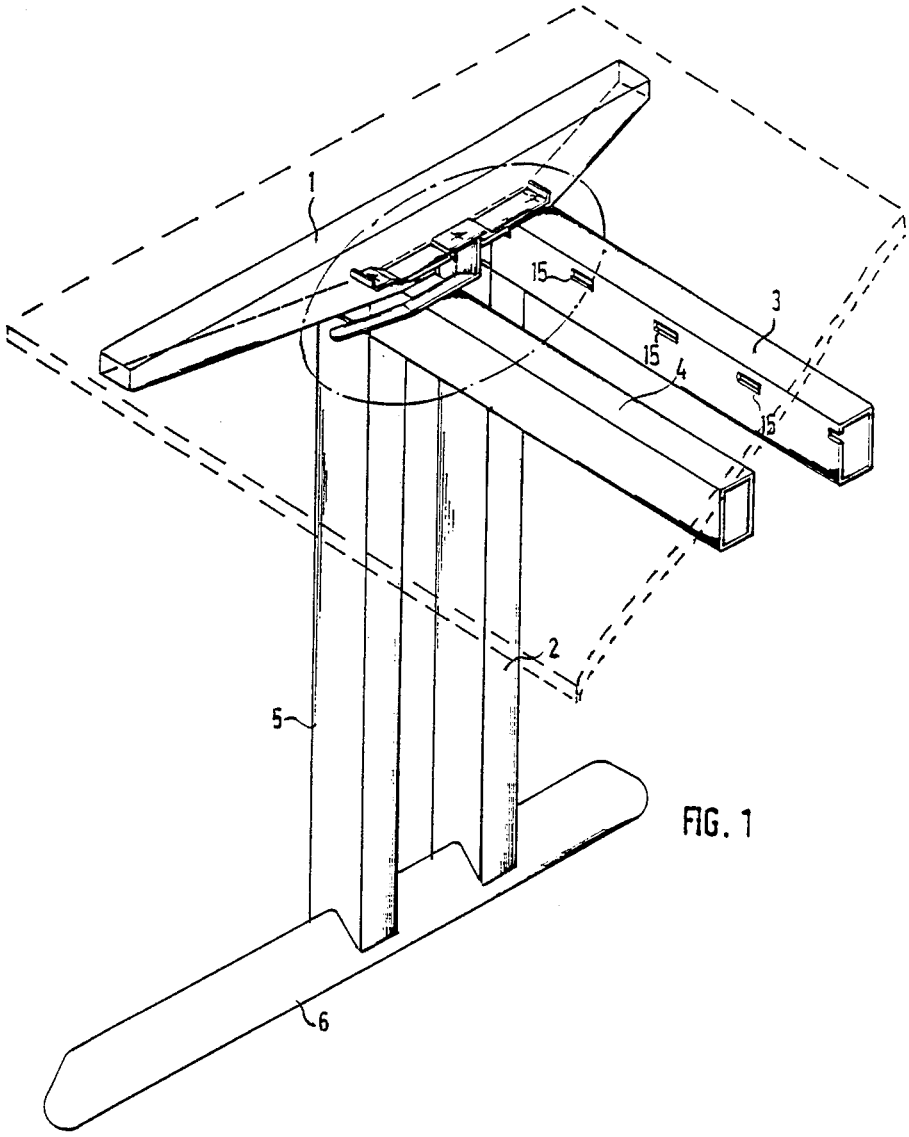
FIG. 1 is a perspective view of a section of a desk top support structure showing the attachment mechanism that is mounted on the underside of the desk top (but illustrating the top itself in broken lines, for purposes of clarity)

FIG. 1 illustrates a portion of a desk that includes the manually operable attaching mechanism of the present invention, and depicts a portion of the desk support structure and a desk top attaching mechanism that is used to attach a desk top to the underlying support structure. The desk top itself is shown in broken lines in FIG. 1 to facilitate illustration of the attachment mechanism that characterizes the present invention.

The attachment mechanism 1, shown generally in FIG. 1 of the drawings, will be described more fully hereinafter by reference to FIGS. 2 and 3. Attachment mechanism 1 comprises a metallic housing that carries or contains the manually operable portions of the mechanism, and it is mounted on the underside of the desk top by means of screws or the like. The support structure with which it cooperates comprises a pair of vertical pedestals, only one of which is shown in FIG. 1, that are disposed in spaced relation to one another. The pedestals include vertical posts 2 and 5 that are fixed at their lower ends to a ground support or base 6. A pair of cross beams 3, 4 extend horizontally in parallel spaced relation to one another between the tops of the two pedestals. In the illustrated embodiment each cross beam 3 and 4 comprises a hollow tube of square or rectangular cross section, and each cross beam further includes abutment means thereon taking the form of a plurality of spaced openings 15 that are provided in an inner vertical face of cross beam 3, and a similar plurality of spaced openings 14 (see FIG. 2) that are disposed in the inner facing surface of cross beam 4.

Figure 2:
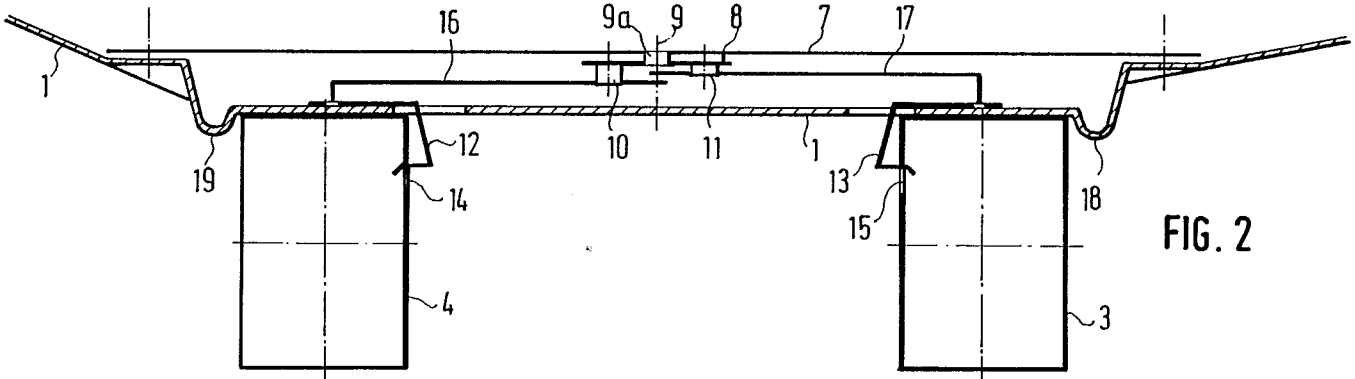
FIG. 2 is a diagrammatic cross section of the attachment mechanism of the present invention.
Figure 3:
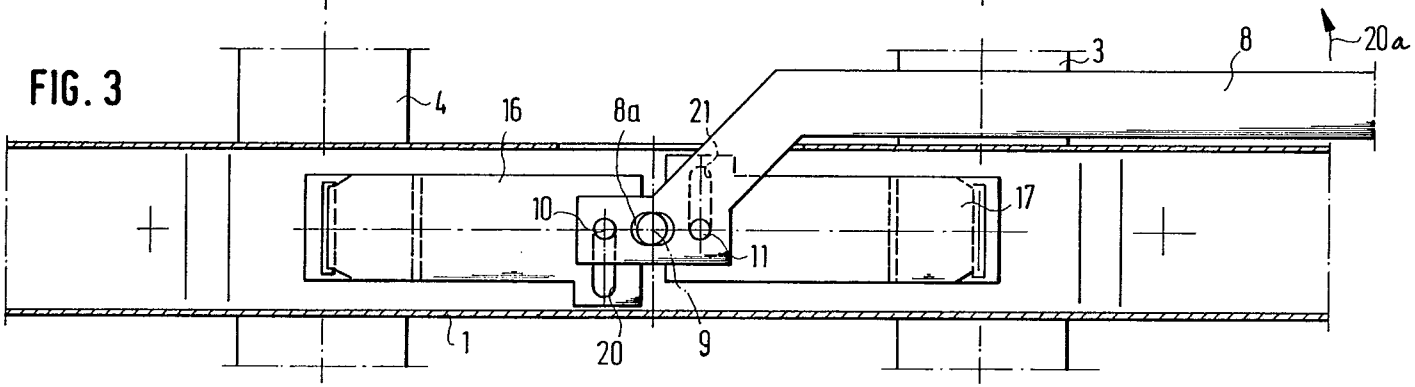
FIG. 3 is a top view of the structure shown in FIG. 2.

Referring now to FIGS. 2 and 3, the lower surface of the housing of attachment mechanism 1 includes a pair of downwardly extending protuberances or lugs 18, 19 that are equally spaced from the center line of the table top, and that are spaced from one another by a distance corresponding to the distance between the outer faces of cross beams 3 and 4. Protuberances or lugs 18, 19 are positioned respectively adjacent the outer faces of cross beams 3 and 4 when the desk top is placed on said cross beams, and act as centering elements which properly locate the desk top relative to the cross beams to assure that the weight of the table top is evenly distributed on the support structure, and to correctly position the manually operable portions of the attachment mechanism relative to openings 14, 15 in the cross beams. A similar result may be achieved by so positioning centering elements 18, 19 that they engage the inner, rather than the outer, vertical faces of cross beams 3 and 4 when the desk top is correctly positioned on the support structure.

The attachment mechanism includes a horizontal plate 7 within the housing of attachment mechanism 1. Plate 7 is attached by screws or the like to said housing adjacent the bottom of the attachment mechanism, and has a downwardly extending pivot pin 9 thereon which defines an axis of rotation 9*a* for a manually operable latching lever 8. Pivot pin 9 is inserted into an oblong hole 8*a* (see FIG. 3) in the latching lever, the length of hole 8*a* being slightly greater than the diameter of pivot pin 9. The oblong hole 8*a* extends lengthwise in the direction of elongation of the attachment mechanism, and makes it possible for the pivot of latching lever 8 to be displaced in the direction of elongation of the attachment mechanism when latching lever 8 is pivoted about pin 9 in the manner depicted by arrow 20*a* in FIG. 3.

The inner end of latching lever 8 includes a portion which overlaps the inner ends of a pair of elongated, spaced, colinear clamp levers 16 and 17 that extend in directions transverse to the directions of elongation of cross beams 3 and 4. Pivot pin 9 is located between the respective inner ends of clamp levers 16 and 17, and a pair of further pins 10 and 11 are mounted on the overlap portion of latching lever 8, on opposite sides respectively of pivot pin 9, and extend from latching lever 8 into a pair of oblong or elongated slots 20 and 21 that are provided respectively in clamp levers 16 and 17. Slots 20 and 21 are parallel to one another and parallel to the directions of elongations of cross beams 3 and 4, i.e., they extend in directions transverse to the direction of elongation of oblong hole 8*a* and transverse to the direction of elongation of the attachment mechanism.

The outer ends of clamp levers 16 and 17 include downwardly extending flanges which loosely engage complementary slots in a pair of clamp hooks 12 and 13. In the alternative, clamp hooks 12 and 13 may be formed as integral portions of clamp levers 16 and 17, without any major effect on their function. The lower ends of clamp hooks 12 and 13 are positioned adjacent openings 14, 15 in the cross beams and are designed to enter the tops of the openings obliquely when clamp levers 16 and 17 are moved away from one another by pivotal motion of latching lever 8 about pivot 9*a*.

When the desk top is properly positioned on cross beams 3 and 4, and latching lever 8 is in the position generally shown in FIG. 3, clamp hooks 12 and 13 are located adjacent, but outward of, holes 14 and 15 in the cross beams of the support structure. The latching lever 8 can then be manually pivoted away from the clamp levers 16 and 17, as generally depicted by arrow 20*a*, to cause the clamp levers 16 and 17 to be displaced in translation away from one another. This causes clamp hooks 12, 13 to engage holes 14, 15 in the cross beams, thereby to firmly fix the desk top in position on the support structure. To release the attachment the latching lever 8 is pivoted toward clamp levers 16, 17, to cause the clamp levers 16 and 17 together with clamp hooks 12 and 13 to move toward shaft 9 and to separate the clamp hooks from openings 14 and 15. The desk top can then be readily removed from the support structure together with attachment mechanism 1.

In the embodiment illustrated in FIGS. 2 and 3 the oblong holes 20 and 21 are provided in clamp levers 16 and 17, and the shafts 10 and 11 are mounted on latching lever 8. It is possible to achieve the same result by placing the oblong holes 20 and 21 in the latching lever, and mounting shafts 10 and 11 on clamp levers 16 and 17.

The use of an oblong hole 8*a* in the pivot structure makes it possible to displace the pivot axis of latching lever 8 during the operation described above. This achieves the advantage of always assuring that automatic centering occurs, so that clamp hooks 12 and 13 always fit into openings 14 and 15 in the same way. The mechanism thus compensates for manufacturing imprecision when the assembly operation is being effected, without affecting the assembly operation itself or the security of the attachment that is achieved by use of the attachment mechanism.

While we have thus described preferred embodiments of the invention, variations will be readily apparent to those skilled in the art. It must therefore be understood that all such variations as are in accord with the principles of the present invention are intended to fall within the scope of the appended claims.

Having thus described our invention we claim:

1. A desk comprising a support structure and a desk top adapted to be mounted on said support structure, said support structure including a pair of vertical pedestals disposed in spaced relation to one another and a pair of elongated horizontally extending parallel cross beams disposed between said pedestals adjacent the tops when said desk top is mounted on said support structure of said pedestals at a location below said desk top, each of said cross beams including abutment means thereon, and the underside of said desk top including an attachment mechanism thereon for separably attaching said desk top to said support structure, said attachment mechanism comprising a manually operable latching lever mounted for pivotal motion in a plane parallel to the underside of said desk top, a pair of clamp levers mounted for horizontal linear motion toward and away from one another in a direction transverse to said elongated cross beams, and motion changing means responsive to pivotal motion of said latching lever in one direction for effecting linear motion of said clamp levers into engagement with said abutment means on said cross beams, and responsive to pivotal motion of said latching lever in a direction opposite to said one direction for disengaging said clamp levers from said abutment means.

2. The desk of claim 1 wherein said cross beams are hollow tubes, said abutment means comprising openings in the walls of said tubes, said clamp levers having free end portions which extend through said openings into the interiors of said hollow tubes when said clamp levers are in engagement with said abutment means.

3. The desk of claim 2 wherein said openings are formed in inner facing walls of said pair of cross beams.

4. The desk of claim 1 wherein said pair of clamp levers respectively comprise elongated members mounted in spaced alignment with one another transverse to said elongated cross beams, said latching lever being mounted for pivotal motion in a pivot structure which comprises a pivot pin located in an elongated oblong pivot hole, said pivot structure being disposed between adjacent ends of said elongated clamp levers.

5. The desk of claim 4 wherein said oblong pivot hole is in said latching lever, said pivot pin being mounted on a plate adjacent said latching lever and extending from said plate into said oblong pivot hole.

6. The desk of claim 4 wherein said latching lever includes an inner end portion which overlaps the adjacent ends of said elongated clamp levers, said motion changing means comprising a pair of pins that are disposed between said latching lever and said clamp levers in the region of said overlap, said pair of pins being respectively disposed in a pair of elongated slots that are also located in the region of said overlap, said elongated slots being parallel to one another and transverse to the directions of elongation of said clamp levers.

7. The desk of claim 6 wherein said pair of elongated slots are located respectively in said pair of clamp levers on opposite sides of said pivot structure, said pair of pins being mounted on said latching lever.

8. The desk of claim 1 wherein said attachment mechanism includes a pair of protuberances which are positioned respectively adjacent said pair of cross beams to center said desk top relative to said support structure.

9. The desk of claim 1 wherein said pair of clamp levers comprise a pair of elongated members that are mounted in spaced alignment with one another, said elongated members respectively having inner end portions that are closely adjacent one another and outer end portions that are remote from one another, said outer end portions including engaging means for engaging said abutment means on said cross beams, said latching lever being mounted for pivotal motion on a pivot structure that is disposed between said inner end portions of said elongated members, said pivot structure defining an axis of rotation of said latching lever that can be linearly displaced in a direction parallel to said elongated clamp levers.

10. The desk of claim 9 wherein said abutment means comprise openings in side walls of said cross beams, said engaging means at the outer end portions of said clamping levers having hook sections which are adapted to enter said openings obliquely to lock said desk top in position on said support structure.

* * * * *